United States Patent [19]

Hori

[11] Patent Number: 4,760,785

[45] Date of Patent: Aug. 2, 1988

[54] PRINTER WITH ROTATING HAMMERS

[75] Inventor: Fumihisa Hori, Takizawa, Japan

[73] Assignee: Alps Electric Co., Ltd., Japan

[21] Appl. No.: 937,048

[22] Filed: Dec. 2, 1986

[30] Foreign Application Priority Data

Dec. 25, 1985 [JP] Japan ..... 60-198213[U]
Dec. 25, 1985 [JP] Japan ..... 60-198211[U]

[51] Int. Cl.[4] ..... B41J 1/32; B41J 9/26

[52] U.S. Cl. ..... 101/93.28; 101/93.18; 101/93.21; 101/93.48; 400/645.1

[58] Field of Search ..... 400/247, 248, 248.1, 400/248.2, 248.3, 642, 643, 644, 645, 645.1, 645.2, 645.3, 645.4, 645.5, 157.1, 157.2; 101/93.18, 93.19, 93.20, 93.21, 93.22, 93.23, 93.26, 93.27, 93.28, 93.29, 93.48

[56] References Cited

U.S. PATENT DOCUMENTS

| | | | |
|---|---|---|---|
| 2,625,100 | 1/1953 | Williams et al. | 101/93.02 |
| 3,017,981 | 1/1962 | Keith | 400/248 |
| 3,874,285 | 4/1975 | Kodaira et al. | 400/248 |
| 3,918,568 | 11/1975 | Shimodaira | 101/93.48 |
| 3,920,113 | 11/1975 | Tamai | 101/93.48 |
| 3,954,054 | 5/1976 | Busch | 101/93.18 |
| 4,037,532 | 7/1977 | Plaza et al. | 101/93.48 |
| 4,189,997 | 2/1980 | Nozaki et al. | 101/93.23 |
| 4,402,261 | 9/1983 | Ohtsuki et al. | 101/93.29 |

FOREIGN PATENT DOCUMENTS

| | | | |
|---|---|---|---|
| 11285 | 2/1981 | Japan | 101/93.48 |
| 34488 | 4/1981 | Japan | 400/645.1 |

*Primary Examiner*—David Wiecking
*Attorney, Agent, or Firm*—Guy W. Shoup; Leighton K. Chong

[57] ABSTRACT

A printer provided with a plurality of printing type wheels, which have printing types at their periphery and can be selectively stopped at the printing position and a hammer disposed so as to be opposite to said printing type wheels, which can push recording paper against them, in which the hammer is made of a material of relatively hard synthetic resin and has a plurality of chevron shaped comb-like thrusting portions corresponding to the printing type wheels, each of the thrusting portions being constructed so as to include a hollow inside.

2 Claims, 11 Drawing Sheets

PRINTER WITH ROTATING HAMMERS

FIELD OF THE INVENTION

This invention relates to a printer using printing type wheels and in particular to the structure of a hammer and an erroneous printing preventing plate, with which a line printer having a plurality of printing type wheels is provided.

BACKGROUND OF THE INVENTION

Such a line printer is provided with a plurality of printing type wheels, each of which has printing types at its periphery and can be stopped at the printing position, and a hammer, which is disposed so as to be opposed to the printing type wheels, and so constructed that desired printing types are transcribed on recording paper by the fact that the hammer pushes the recording paper, which is located so as to be opposed through an ink ribbon to the printing wheels or which is located so as to be opposed to the printing wheels, on which ink is applied by means of an ink roll, against printing types selected to be at the printing position.

However, for such a printer, it is necessary that the hammer described above has a superficial hardness greater than a certain value and at the same time that the hammer is deformable, in order to transcribe clearly the printing types on the recording paper. For the purpose of satisfying these requirements, heretofore, a hammer illustrated in FIG. 16 has been proposed.

In FIG. 16 the reference numeral 100 represents a printing type wheel having printing types 101 on its peripheral surface; 102 recording paper; and 103 a hammer. The hammer 103 consists of a holder 105, which is rotatable in the direction indicated by an arrow around a supporting shaft 104, a cylindrical body 106 made of an elastic material, such as rubber, etc., held at the extremity of this holder 105 and a sleeve 107 made of a relatively hard material, such as a synthetic resin, etc., which is fitted into this cylindrical body 106.

Now, when the hammer 103 is rotated up to the printing position, as indicated in FIG. 16, where the printing wheel 100 is stopped, so that a desired printing type 101 is located at the printing position and recording paper 102 is carried to the position opposite to the printing type 101, the cylindrical body 106 of the hammer 103 is compressed and deformed and its repulsive force acts through the hard sleeve 107 on the recording paper 102. In this way, the recording paper 102 is pushed against the printing type 101, which is at the printing position, by the thrusting force of the hammer and the desired type is transcribed on the recording paper 102.

However, in the prior art example described above, since the hammer 103 is constituted of the holder 105, the cylindrical body 106 and the sleeve 107, it has drawbacks that the construction is complicated and that the production cost rises and the number of steps for assembling is increased. Furthermore it is another drawback that, when the center of supporting shaft 104 or the cylindrical body 106 is deviated from the center of the printing type wheels 100, the thrusting force of the hammer 103 cannot act uniformly on the plurality of the printing type wheels and thus non-uniformity of the print is produced.

Further, in such a printer there is a drawback that, when the size of the printing wheel and the interval between two adjacent printing types are reduced for the purpose of reducing the size of the whole printer, printing types other than the selected printing types are brought into contact with the recording paper so that erroneous printing types are transcribed or the recording paper becomes dirty.

OBJECT OF THE INVENTION

An object of this invention is, therefore, to provide a printer, which is not expensive and permits to print clearly types for every digit. Another object of this invention is to provide a printer, which prevents for the printing types other than those which are at the printing position to be transcribed to the recording paper and permits to make the printing type wheel smaller.

SUMMARY OF THE INVENTION

In order to achieve the object described above, this invention is characterized in that it comprises a plurality of printing type wheels, each of which has printing types at its periphery and can be stopped at the printing position, a hammer, which is disposed so as to be opposed to the printing type wheels and can push the recording paper against it, and an erroneous printing preventing plate disposed between the recording paper and the printing type wheels. In addition, this invention is characterized in that the hammer is made of relatively hard synthetic resin; that at the same time the hammer has a plurality of comb-shaped thrusting portions corresponding to the printing type wheel; a hollow is formed inside of each of the thrusting portions; and that in the erroneous printing preventing plate a hole corresponding to each of the printing type wheels is formed, the central portion of which is bent so that it protrudes by a length which is approximately equal to a printing type on the printing type wheel.

That is, since the thrusting portion is made of relatively hard synthetic resin in a hollow structure, at the moment of a printing operation, when the thrusting portion of the hammer in pushed through the printing paper against the printing type wheel, it is easily deformed while keeping its superficial hardness and consequentlyy the printing type can be clearly transcribed on the recording paper. Furthermore, since the thrusting portions are disposed separately for every printing type wheel corresponding to one of a plurality of digits, even if the hammer is mounted more or less deviated with respect to the corresponding printing type wheel, the thrusting force is applied uniformly for all the digits and therefore no printing non-uniformity is produced. In addition, a desire printing type on the printing type wheel, which is selected to be at the printing position, protrudes through a hole of the erroneous printing preventing plate towards the hammer and the other printing types are separated by the erroneous printing preventing plate from the recording paper. Consequently, when the hammer pushes the recording paper against the printing type wheels, only the printing types protruding through the holes formed in the erroneous printing preventing plate are transcribed on the recording paper and printing types which are not at the printing position are never erroneously transcribed.

BRIEF DESCRIPTION OF THE DRAWINGS

FIG. 7 (*b*) is a cross-sectional view along the line E—E in FIG. 7 (*a*);

DETAILED DESCRIPTION

Figure 1:
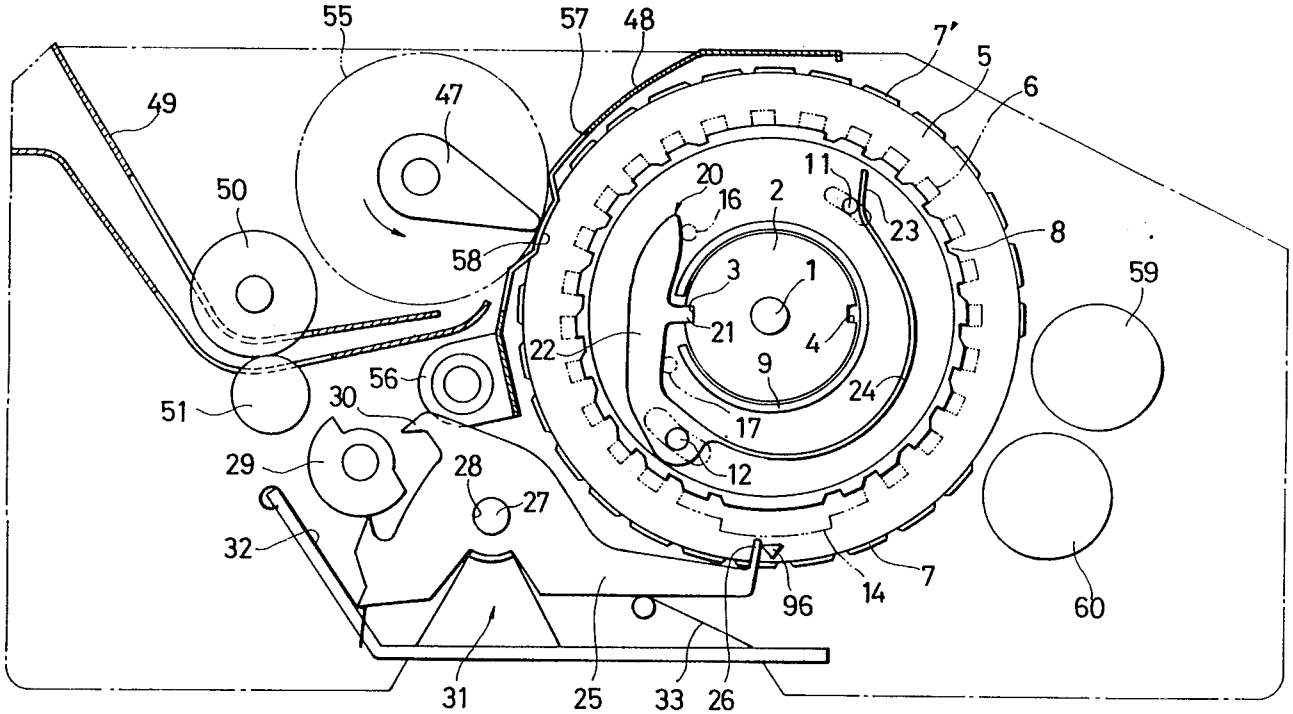
FIG. 1 is a schematical side view of a printer according to an embodiment of this invention.

Hereinbelow some preferred embodiments of this invention will be explained, referring to the drawings.

FIG. 1 is a side view illustrating schematically a printer according to an embodiment of this invention. In the figure, the reference numeral 1 indicates a rotating shaft, which is so constructed that it can be rotated in the normal and reverse directions by the driving force of a motor not indicated in the figure through a series of gears described later. The reference numeral 2 is a driving shaft which rotates together with this rotating shaft 1 in one body and on the peripheral surface of which two cut-off portions 3 and 4 are formed diametrically opposite to each other in the axial direction. The reference numeral 5 represents a printing type wheel mounted on the driving shaft 2 and 6 a selection ratchet mounted similarly on the driving shaft 2, which is indicated by an alternate one-long and two-short dash line.

Figure 2:
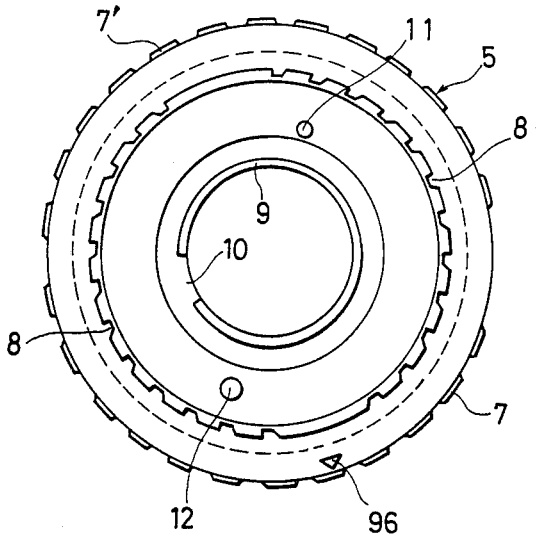
FIG. 2 is a front view of a printing type wheel.
Figure 3:
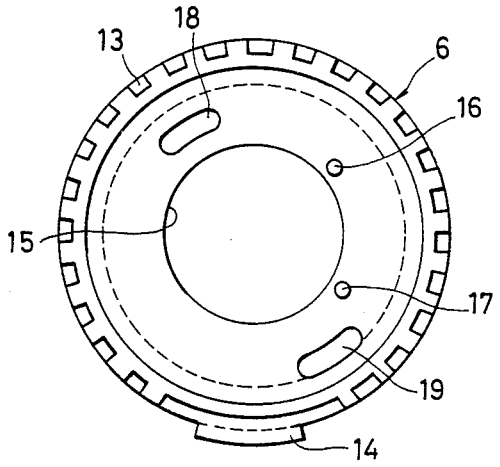
FIG. 3 is a front view of a selection ratchet.

FIG. 2 is a plan view of the printing type wheel 5 and FIG. 3 is a front view of the selection ratchet 6 stated above. As indicated in FIG. 2, on the outer surface of the printing type wheel 5 are disposed two groups of printing types 7, 7′, each of which is consituted e.g. of "0, 1, 2, . . . , 9, +, −, ×, ÷" etc. On the inner surface thereof are disposed a plurality of lock grooves 8 corresponding to the printing types 7, 7′ and at the center portion is mounted a bearing 9, into which the driving shaft 2 is inserted. At a part of this bearing 9 is formed a gap portion 10. Further, outside the bearing 9 an engaging shaft 11 and a supporting shaft 12 are disposed diametrically opposite to each other with respect to the center of the printing type wheel 5.

On the other hand, as indicated in FIG. 3, on the outer peripheral surface of the selection ratchet 6 stated above are disposed a plurality of toothed portions 13 corresponding to the printing types 7, 7′ and an engaging protrusion 14. Further, at its central portion a hole 15 is formed, into which the bearing 9 of the printing wheel 5 is inserted. Outside the periphery of this hole 15 release pins 16 and 17 are disposed with a predetermined distance and oval engaging holes 18 and 19 corresponding to the engaging shaft 11 and to the supporting shaft 12, respectively, are formed, which holes are sufficiently large to tolerate their small positional variations.

Again referring to FIG. 1, the reference numeral 20 represents a driving nail disposed between the printing type wheel 5 and the selection ratchet 6. The rotating force of the rotating shaft 1 is transferred by this driving nail 20 to the printing type wheel 5. This driving nail 20 consists of a first arm portion 22 having a certain rigidity and a protrusion 21, which can engage with the cut-off portions 3 and 4 of the driving shaft 2 and a second arm portion 24 having a sliding portion 23, which is elastic and elastically in contact with the engaging shaft 11, and the base portion of the first arm portion 22 is inserted rotatably into the supporting shaft 12 of the printing type wheel 5. On the other hand, as indicated by alternate one-long and two-short dash lines in the figure, both the release pins 16 and 17 of the selection ratchet 6 are located through the protrusion 21 of the driving nail 20 at the neighborhood of the first arm portion 22 and the extremity of the engaging shaft 11 and that of the supporting shaft 12 on the printing type wheel 5 are located in the engaging holes 18 and 19, respectively, of the selection ratchet 6.

Further, the reference numeral 25 in FIG. 1 represents a selection nail, which can stop the rotation of the selection ratchet 6. The selection ratchet 25 comprises a nail 26 at its extremity, which can engage with the toothed portions 13 and the engaging protrusion 14 of the selection ratchet 6 as well as the lock groove 8 of the printing type wheel 5, a hole 28 at its central portion, into which a rotation shaft 27 is inserted, and a cam nail 30 engaging with a reset cam 29 at its rear end. The reference numeral 31 is a driving means, e.g. an electromagnetic clutch, which can transfer selectively the rotational force of the rotation shaft 27 to the selection nail 25; 32 an engaging spring, which can hold the selection nail 25 in the state where it is engaged with the selection ratchet 6; and 33 a pushing spring holding the selection nail 25 in the state, where it is separated from the selection ratchet 6, together with the engaging spring 31.

Figure 4:
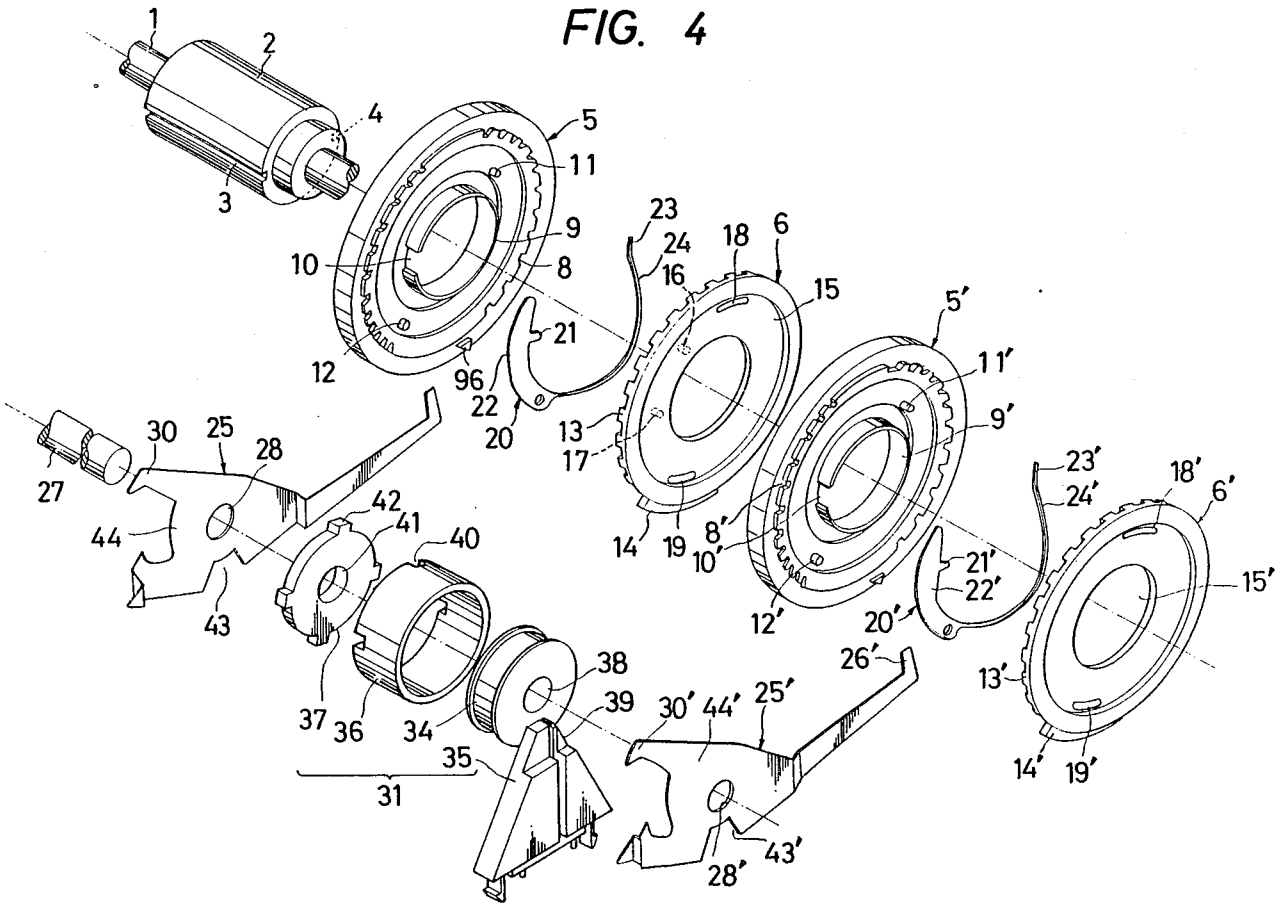
FIG. 4 is an exploded perspective view showing the relation among printing type wheels, selection ratchets, driving nails, selection nails and an electro-magnetic clutch.

FIG. 4 is an exploded perspective view illustrating the relation among printing type wheels 5, selection ratchets 6, driving nails 20, selection nails 25 and the electro-magnetic clutch 31. As indicated in this figure, the electro-magnetic clutch 31 stated above consists in broad outline of a elector-magnetic coil 34, a supporter 35, a yoke 36 and a rotor 37. The electro-magnetic coil 34 has a hole 38 at its central portion, into which the rotation shaft 27 mentioned above is inserted, and is supported by a sector-shaped projection 39, which is the upper portion of the supporter 35. The cylindrical yoke 36 is mounted so as to enclose this electro-magnetic coil 34 and at its one end are formed four cut-off portions 40 with an intertval of 90°. At the central portion of the rotor 37 made of non-magnetic substance is formed a hole 41, into which the rotation shaft 27 is inserted. By this fact the rotor 37 rotates together with the rotation shaft 27 in one body and at the periphery of the rotor 37 are formed four projections 42 engaging with the cut-off portions 40 of the yoke 36 similarly with an intertval of 90°. Only one electro-magnetic clutch 31 thus constructed can rotate two selection nails, i.e. a first selection nail 25 and a second selection nail 25' in the figure. These first and second selection nails 25 and 25' comprise, as already mentioned, the nails 26 and 26' at their extremity, the holes 28 and 28' at their central portion and the cams 30 and 30' at their rear end, respectively. Further, at their lower parts are formed sector-shaped cut-off portions 43 and 43', which have a shape similar to but slightly greater than that of the projection 39 of the supporter 35.

When these first and second selection nails 25 and 25' and the electro-magnetic clutch 31 are assembled, the yoke 36 is mounted on the electro-magnetic coil 34 so as to enclose this electro-magnetic coil 34, as mentioned above, and the projections 42 of the rotor 37 are so arranged that each of them is fitted into each of the cut-off portions 40 of the yoke 36. Further the two selection nails 25 and 25' are mounted rotatably with respect to the rotation shaft 27 and so that their cut-off portions 43 and 43' are engaged with the projection 39 and the rotor 37 is secured to the rotation shaft 27 in one body. In an assembly thus constructed the trunk portions 44 and 44' of the two selection nails 25 and 25' are so disposed that each of them is opposite to each of the end surfaces of the yoke 36.

On the other hand, the printing type wheels 5, the selection ratchets 6 and the driving nails 20 are mounted on the driving shaft 2 in the following manner. That is, for example, the bearing 9 of the first printing type wheel 5 is mounted on the driving shaft 9 by inserting the latter in the former. Then the supporting shaft 12 of the first printing type wheel 5 is inserted in the hole formed in the driving nail 20 and the protrusion 21 of the first arm portion 22 is inserted in the air gap 10. After that, for example, this protrusion 21 is engaged with the cut-off portion 3 of the driving shaft 2. In addition the second arm portion 24 is mounted so that its sliding portion 23 is elastically in contact with the engaging shaft 11 of the first printing type wheel 5. Next, the bearing 9 of the first printing type wheel 5 is inserted in the hole 15 of the first selection ratchet 6 and thus the first printing type wheel 5 is mounted so that its release pins 16 and 17 are inside of the first arm portion 22 and its engaging holes 18 and 19 correspond to the engaging shaft 11 and to the supporting shaft 12, respectively.

The second printing type wheel 5', selection ratchet 6', and driving nail 20' are mounted on the driving shaft 2 in the same manner as for the first printing type wheel 5, selection ratchet 6, and driving nail 20. That is, the driving shaft 2 is inserted in the bearing 9' of the second printing type wheel 5'; then the supporting shaft 12' of the second printing type wheel 5' is inserted in the hole formed in the driving nail 20'; the protrusion 21' of the first arm portion 22' is inserted in the gap portion 10' of the bearing 9'; and finally this protrusion 21' is engaged with the cut-off portion 3 of the driving shaft 2. In addition the second arm portion 24' is mounted so that its sliding portion 23' is elastically in contact with the engaging shaft 11' of the second printing type wheel 5'. Next, the bearing 9 of the second printing type wheel 5' is inserted in the hole 15' of the second selection ratchet 6' and thus the second printing type wheel 5' is mounted so that its release pins (not indicated in the figure) are inside of the first arm portion 22' and its engaging holes 18' and 19' correspond to the engaging shaft 11' and to the supporting shaft 12', respectively.

Furthermore, the first printing type wheel 5, the first selection ratchet 6, the second printing type wheel 5', and the second selection ratchet 6' described above are arranged on the driving shaft 2 so that the phase of the toothed portions 13 of the first selection ratchet 6 and the toothed portions 13' of the second selection ratchet 6' are different from each other, e.g. that they are shifted by ½ pitch from each other, that is, the summits of the toothed portions 13' are located at the position corresponding to that of the bottoms of the toothed portions 13.

In addition, although they are not indicated in the figure, a plurality of, e.g. nine combinations of two printing type wheels 5, 5', two selection ratchets 6, 6', two driving nails 20, 20', two selection nails 25, 25' and one electro-magnetic clutch 31 described above are arranged axially along the driving shaft 2 and the rotation shaft 27.

Figure 5A:
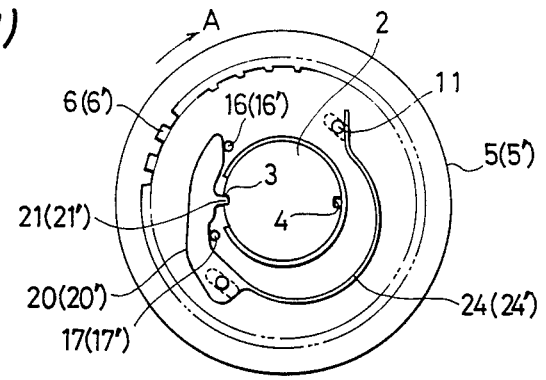
FIGS. 5 (*a*)~(*c*) are schemes for explaining the engaging relation between the driving shaft and the driving nail.
Figure 5B:
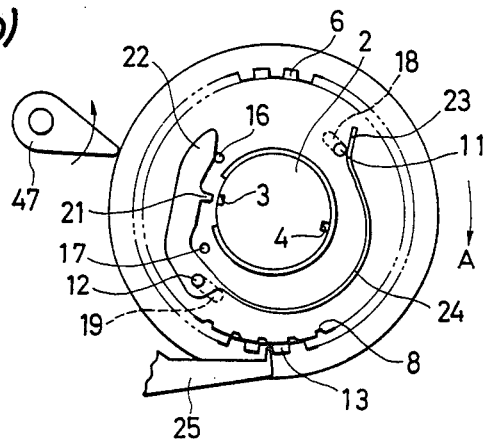
Figure 5C:
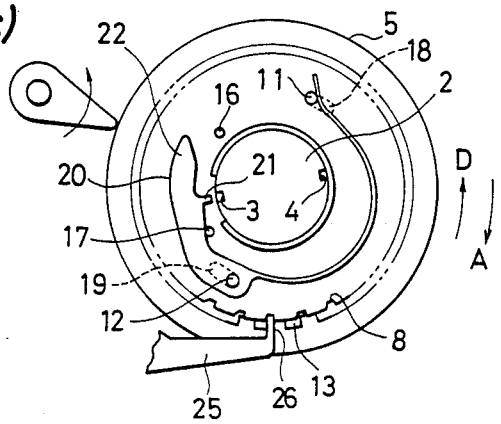

FIGS. 5 (*a*)~(*b*) are schemes for explaining the relation of engagement between the driving shaft 2 and the driving nails 20, 20' described above, and FIGS. 6 (*a*)~(*b*) are schemes for explaining the relation of engagement between the selection ratchets 6, 6' and the selection nails 25, 25'. The printing type selection operation of the printing type wheels 5 and 5' will be explained below, referring principally to these figures.

Figure 6A:
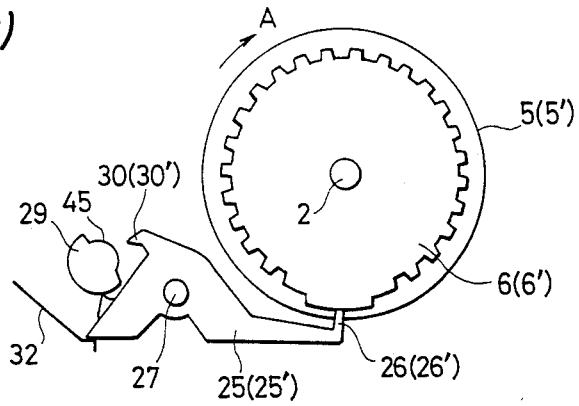
FIGS. 6 (*a*)~(*c*) are schemes for explaining the engaging relation between the selection ratchet and the selection nail.
Figure 6B:
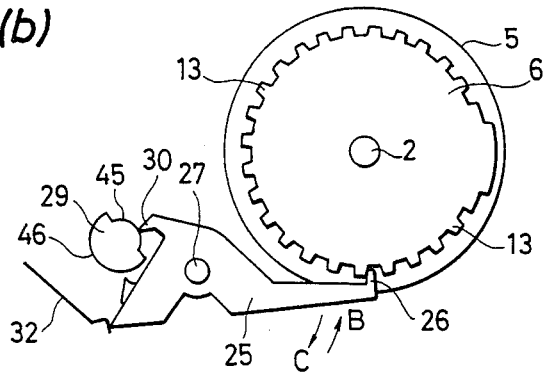
Figure 6C:
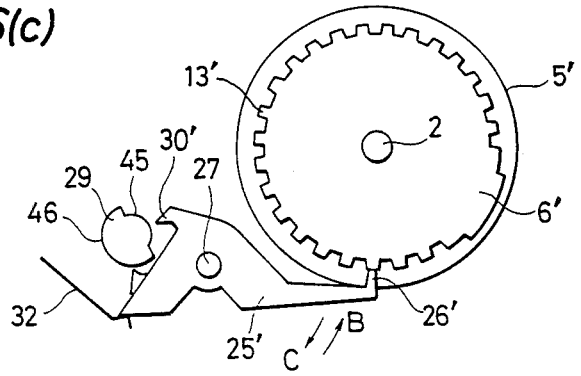

At first, in the state where, as indicated in FIG. 5 (*a*), the protrusions 21 and 21' of the driving nails 20 and 20' are engaged with the cut-off portion 3 of the driving shaft 3, and at the same time in the waiting state where, as indicated in FIG. 6 (*a*), the extremity portions of the selection nails 25 and 25' have not yet overridden the projecting portions of the engaging springs 32 and 32', when the driving shaft 2 and the rotation shaft 27 rotate in the direction indicated by an arrow A in FIGS. 5 and 6 e.g. by means of a motor not shown in the figures, the rotational force is transmitted to the driving nails 20 and 20' by the engagement of the protrusions 21 and 21' of the driving nails 20 and 20' with the cut-off portion 3 with the rotation of the driving shaft 2. This rotational force is further transmitted from the first arm portion 22 of the driving nails 20 and 20' to the release pins 16, 17, 16' and 17' of the selection ratchets 6 and 6'. In this way the printing type wheels 5 and 5', the selection ratchets 6 and 6' and the driving shaft 2 rotate in one body in the direction indicated by the arrow A. In addition, during this movement, although the rotor 37 and the yoke 36 rotate with the rotation of the rotation shaft 27, since the rotational force of the rotation shaft 27 is not transmitted to the selection nails 25 and 25', these selection nails 25 and 25' are kept in the waiting state indicated in FIG. 6 (*a*).

At the moment where e.g. a desired printing type 7 or 7' of the first printing type wheel 5 arrives at the neighborhood of the printing position, when electric current is supplied to the electro-magnetic coil 34, the trunk portions 44 and 44' of the selection nails 25 and 25' are attracted thereby to the end surface of the yoke 36. Consequently the selection nails 25 and 25' try to rotate together with the yoke 36 in one body, as indicated by an arrow B in FIGS. 6 (*b*) and (*c*), but since the nail portion 26 of the first selection nail 25 is at a bottom between two adjacent toothed portions 13 of the first selection ratchet 6, the end portion of the selection nail 25 overrides the projecting portion of the engaging spring 32 and rotates in the direction indicated by the arrow B. Thus the nail portion 26 engages with the toothed portions 13 and by this fact the rotation of the first selection ratchet 6 is stopped. Such a state is held stably by the spring force of the engaging spring 32. Thus, when the rotation of the first selection ratchet 6 is stopped by the first selection nail 25, the extremity of the first arm portion 22 of the driving nail 20 is stopped by the release pin 16 mounted on the first selection ratchet 6 with the succeeding rotation of the driving shaft 2 in the direction indicated by the arrow A in FIG. 5 (*a*) and moves outward. That is, this driving nail 20 is expanded against the spring force of the second arm portion 24 and by this fact, as indicated in FIG. 5 (*b*), the engagement of the projection 21 of the first arm portion 22 with the cut-off portion of the driving shaft 2 is removed. In this way the transmission of the rotational force of the rotation shaft 2 to the first selection ratchet 6 and the first printing type wheel 5 is interrupted. Further, at this moment, the engaging shaft 11 and the supporting shaft 12 mounted on the first printing type wheel 5 are engaged with the end portions of the engaging holes 18 and 19, respectively, formed in the first selection ratchet 6, as indicated in FIG. 5 (*b*), and in this way the relative position of the first printing type wheel 5 and the first selection ratchet 6 is regulated. In addition, when the second arm portion 24 of the driving nail 20 is expanded, since the sliding portion 23 at its extremity is bent in the direction of the expansion of the second arm portion 24 and elastically in contact with the engaging shaft 11 of the first printing type wheel 5, it is slidably in contact with the engaging shaft 11 with a relatively small friction force and further since this engaging shaft 11 is disposed at a position opposite to the supporting shaft 12 with respect to the center of the driving shaft 2, the second arm portion 24 can be so long that its spring constant can be set to be small. That is, when the protrusion 21 of the driving nail 20 is engaged with the cut-off portions 3 and 4 of the driving shaft 2, the engaging force is great and when this engagement is removed, the load can be reduced to a small value.

On the other hand, as mentioned previously, due to the phase shift of ½ pitch the nail portion 26′ is in contact with the toothed portions 13′ of the second selection ratchet 6′, as indicated in FIG. 6 (*c*), and the second selection nail 25′ is held in this state. Consequently the second selection ratchet 6′ and the second printing type wheel 5′ continue to rotate. Further, e.g. when electric current supplied to the electro-magnetic coil 34 is interrupted in synchronism with the stop of the rotation of the first printing type wheel 5, the transfer of the rotational force of the rotation shaft 27 to the second selection nail 25′ is ceased and the second selection nail 25′ returns to the waiting state indicated in FIG. 6 (*a*) owing to the force of the engaging spring 32. Therefore, in spite of the rotation of the driving shaft 2, this second selection nail 25′ is not engaged with the second selection ratchet 6′.

When a desired printing type 7 or 7′ of the second printing type wheel 5′ arrives at the neighborhood of the printing position, electric current is supplied to the electro-magnetic coil 34 and by this fact the second printing type wheel 5′, which has been in the waiting state, is positioned in the same way as the first printing type wheel 5 described above. Thus the state indicated in FIG. 6 (*b*) is realized. Further, the printing types disposed on printing type wheels other than those indicated in the figure are also positioned in the same way as that explained above and thus a desired printing operation can be effected.

When the nail portions 26 and 26′ of the selection nails 25 and 25′ are engaged with the toothed portions 13 and 13′ of the selection ratchets 6 and 6′, respectively, as described above, i.e. during the operation for selecting the printing type 7, 7′, the cam nails 30 and 30′ of the selection nails 25 and 25′ are at positions, which are opposite to the step-down portion 45 formed on a reset cam 29, as indicated in FIG. 6 (*b*). When the printing operation stated above is terminated, the cam nails 30 and 30′ of the selection nails 25 and 25′ are brought into contact with the projecting portion 46 formed on the reset cam 29 due to the rotation of the reset cam 29. In this way all the selection nails including the selection nails 25 and 25′ rotate in the direction indicated by the arrow C in FIGS. 6 (*b*) and (*c*), overriding the projecting portion on the engaging spring 32 and are held again in the waiting state by means of the projecting portion on the engaging spring 32 and the thrusting spring 33. When the selection nails 25 and 25′ are reversed in this way, the engagement of the selection nails 25 and 25′ with the selection ratchets 6 and 6′ is removed. In such a state, when the driving shaft 2 rotates e.g. in the direction indicated by the arrow A in FIG. 5 (*a*), the protrusions 21 and 21′ of the driving nails 20 and 20′ slip on the peripheral surface of the driving shaft 2 and when the cut-off portion 3 or 4 arrives at positions opposite to the projecting portion 21, 21′, the protrusion 21, 21′ engages with the cut-off portion 3 or 4 by the spring force of the second arm portion 24, 24′ of the driving nail 20, 20′. In this way a state where the rotational force of the driving shaft 2 can be transferred again to the selection ratchet and the printing type wheel 5, 5′, as indicated in FIG. 5 (*a*), is realized. In addition, the selection nail, the driving nail, the selection ratchet, the printing type wheel, etc. of the other assembles not shown in the figures perform the operations completely identical to those described above.

The above description of a series of operations is an explanation in the case where the rotation shaft 2 rotates in the direction indicated by the arrow A in FIG. 5 (*a*). However, also in the case where the rotation shaft 2 rotates contrarily thereto in the direction indicated by the arrow D in FIG. 5 (*c*), operations basically identical to those described above are effected. That is, as indicated in FIG. 5 (*c*), e.g. when the toothed portions 13 of the selection ratchet 6 are stopped by the selection nail 25 and the rotation of the selection ratchet 6 is ceased, the approximately central portion of the first arm portion 22 of the driving nail 20 is stopped by the release pin 17 mounted on the selection ratchet 6 with the succeeding rotation of the driving shaft 2 in the direction indicated by the arrow D in FIG. 5 (*c*) and moves outward. Owing to this movement, the engagement of the protrusion 21 of the first arm portion 22 with the cut-off portion 3 of the driving shaft 2 is removed and the transfer of the rotational force of the driving shaft 2 to the selection ratchet 6 and the printing type wheel 5 is interrupted. However, in this case, since the direction of the rotation of the driving shaft 2 is reverse with respect to that of the rotational force, which the rotation of a hammer described later exerts on the printing type wheel 5, the nail portion 26 of the selection nail 25 is engaged with the lock groove 8 formed on the printing type wheel 5, as indicated in FIG. 5 (*c*), for preventing positional deviations of the printing type wheel 5, on which a printing type is selected. This operation will be explained more in detail in an item entitled <PRINTING OPERATION> described later.

Again referring to FIG. 1, the reference numeral 47 represents a hammer which is mounted so as to be opposite to the row of the printing type wheels 5; 48 an erroneous printing preventing plate disposed between these printing type wheels 5 and the hammer 47; 49 a paper guide for guiding recording paper not shown in the figure to the printing position; 50 a paper advancing roller mounted at the neighborhood of this paper guide 49; and 51 a driven roller mounted so as to be opposite to this paper advancing roller 50. The recording paper stated above is put between the paper advancing roller 50 and the driven roller 51 and carried by them.

Figure 7A:
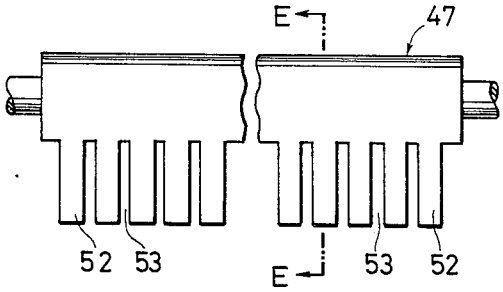
FIG. 7 (*a*) is a plan view of the hammer.
Figure 7B:
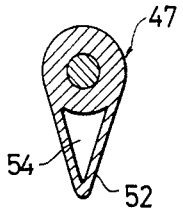

FIG. 7 (*a*) is a plan view of the hammer 47 stated above; the FIG. 7 (*b*) is a cross-sectional view along the line E—E. As indicated in the figures, the hammer 47 has a plurality of, e.g. 18 chevron-shaped thrusting portions 52 corresponding to the number of the printing type wheels 5 and the thrusting portions 52 are separated by cut-off portions 53 from each other. The hammer 47 is made of e.g. relatively hard synthetic resin. However, since a hollow 54 is formed inside of each of the thrusting portions 52, they are easily deformed while keeping their superficial hardness. Further, since the thrusting portions 52 are separated by cut-off portions 53 from each other, e.g. even if hammer 47, printing type wheels 5, etc. are more or less deviated, the thrusting force can be applied uniformly to all of the printing type wheels. The reference numeral 55 indicates the trajectory of the extremity of the hammer 47, i.e. the extremity of the thrusting portions 52, which is indicated by a one-long and two-short dash line in FIG. 1.

Figure 8:
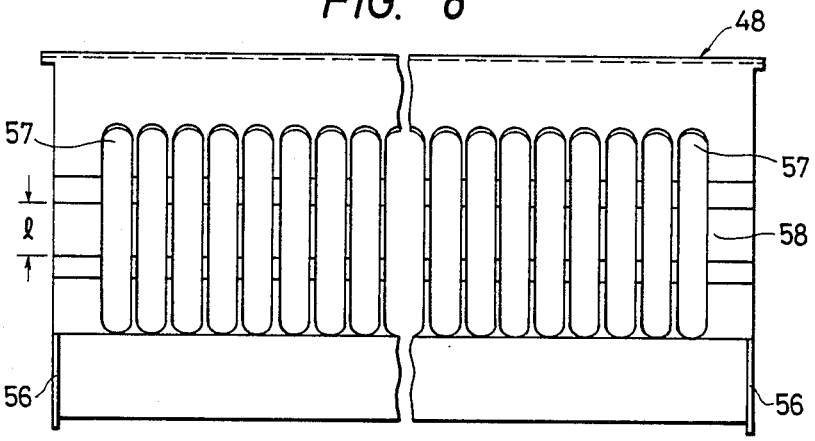
FIG. 8 is a plan view of the erroneous printing preventing plate.

FIG. 8 is a plan view of the erroneous printing preventing plate 48 stated above. As indicated in this figure as well as in FIG. 1, the erroneous printing preventing plate 48 is made of e.g. a bent metallic foil and at both the lower sides are formed edge portions 56 for securing it. Further a plurality of holes 57 are formed with a predetermined distance in the longitudinal direction. The number of holes is e.g. 18, corresponding to the row of the printing type wheels 5. The printing type 7, 7' on each of the printing type wheels 5 corresponds to one thrusting portion of the hammer 47 and as clearly seen from FIG. 1, the erroneous printing preventing plate 48 is so formed that its central portion of the holes 57 is bent so as to protrude, the length (indicated by 1 in FIG. 8) of this projecting portion 58 being set to be approximately equal to one printing type 7, 7' on the printing type wheels 5. Consequently only one selected printing type protrudes through the projecting portion 58 of the holes 57 towards the hammer 47 and the printing types before and after the selected one at the printing position never protrude through the hole 57, although they are opposite to the hole 57.

Figure 9:
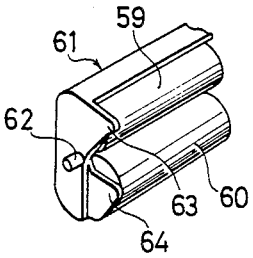
FIG. 9 is a perspective view of a roll supporter and an ink roll.

Further the reference numeral 59 in FIG. 1 represents a first ink roll and 60 a second ink roll. The first ink roll 59 is impregnated with e.g. red ink and the second ink roll 59 is impregnated with e.g. black ink. These first and second ink rolls 59 and 60 are rotatably supported by a roll supporter 61, as indicated in FIG. 9, and supporting shafts 62 (only one is indicated in the figure) mounted at both the sides of the roll supporter 61 are supported rotatably and slidably by a chassis not shown in the figure. In addition the roll supporter 61 is always energized towards the center of the driving shaft 2 stated above by spring means not shown in the figure and at one side end of the roll supporter 61 are formed a first cam nail 63 and a second cam nail 64, these first and second cam nails 63 and 64 being formed so as to be slightly shifted from each other in the axial direction.

Figure 10:
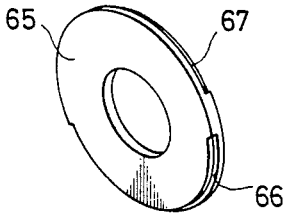
FIG. 10 is a perspective view of a switching cam.

The ink rolls 59 and 60 as well as the roll supporter 61 thus constructed are driven by a switching cam indicated in FIG. 10. This switching cam, which is not indicated in FIG. 1, is so constructed as to rotate in synchronism with the printing type wheels 5 described previously. For example it is disposed on the outer surface of the outermost printing type wheel in one body. Further, as clearly seen from FIG. 10, a first cam groove 66 is formed on about a half of the periphery of a surface of the switching cam 65 and a second cam groove 67 is formed on about another half of the periphery of another surface thereof so that the cam grooves 66 and 67 are not superposed on each other. Thus the first cam nail 63 of the roll supporter 61 stated above is opposite to the first cam groove 66 and the second cam nail 64 of the roll supporter 61 is opposite to the second cam groove 67.

Figure 11A:
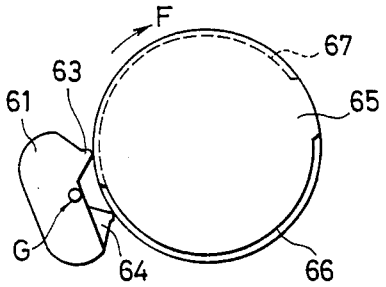
FIGS. 11 (*a*)~(*c*) are schemes for explaining the engaging relation between the roll supporter and the switching cam.
Figure 12A:
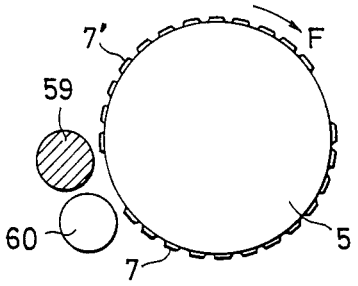
FIGS. 12 (*a*)~(*c*) are schemes for explaining the engaging relation between the ink roll and the printing type wheel.
Figure 11B:
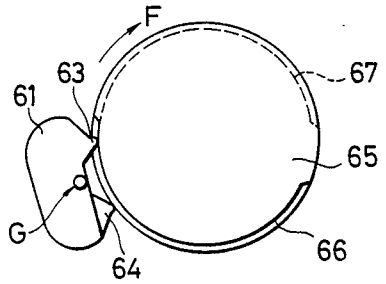
Figure 12B:
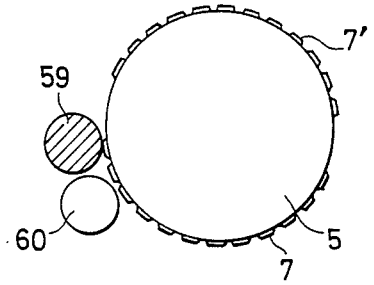
Figure 11C:
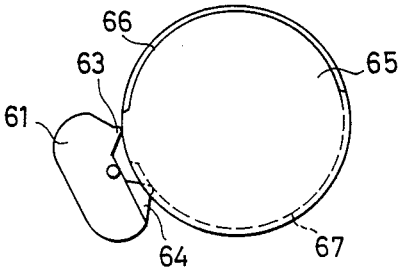
Figure 12C:
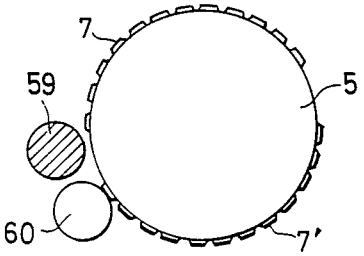

FIGS. 11 (*a*), (*b*) and (*c*) are schemes for explaining the engaging relation between the roll supporter 61 and the switching cam 65 and FIGS. 12 (*a*), (*b*) and (*c*) are schemes for explaining the engaging relation between the ink roll 59, 60 and the printing type wheel 5. Hereinbelow inking by means of the ink rolls 59 and 60 will be explained, referring principally to these figures.

At first, as indicated in FIG. 11 (*a*), in the state where neither the first cam nail 63 of the roll supporter 61 is in the first cam groove 66 of the switching cam 65 nor the second cam nail 64 of the roll supporter 61 is in the second cam groove 67 of the switching cam 65, i.e. in the state where neither the cam nail 63 nor 64 is engaged with the peripheral surface of the switching cam 65, both the ink rolls 59 and 60 are in the state where they are separated from the printing types 7, 7' on the printing type wheels 5, as indicated in FIG. 12 (*a*). When the switching cam 65 rotates e.g. in the direction indicated by the arrow F in FIG. 11 (*a*) from this state, since the first cam nail 63 enters the first cam groove 66 due to the spring force in the direction indicated by C in the figure, but the second cam nail 64 remains to be engaged with the peripheral surface outside the second cam groove 67, as indicated by FIG. 11 (*b*), the first ink roll 59 is pushed against the first printing type 7, as indicated in FIG. 12 (*b*). This state continues, until the first cam nail 63 is in the first cam groove 66 and at the same time the second cam nail 64 falls into the second cam groove 67. In this way ink of the first ink roll 59, e.g. red ink, is applied to all the parts constituting the first printing type 7 on the printing type wheel 5.

When the switching cam 65 rotates until the application to the last printing type 7 by means of the ink roll 59 is terminated, i.e. when the switching cam 65 rotates by about 180° in the direction indicated by the arrow F from the state indicated in FIG. 11 (*a*), the first cam nail 63, which has been in the first cam groove 66 up to this time, rises to the peripheral surface outside the first cam groove 66 and instead thereof, the second cam nail 64 falls in the second cam groove 67, as indicated in FIG. 12 (*c*). Then the first ink roll 59 is separated from the first printing type 7 and the second ink roll 60 is pushed against the second printing type 7'. Such a state is kept during the succeeding about one half turn of the switching cam 65 and in this way ink of the second ink roll 60, e.g. black ink, is applied to all the parts constituting the second printing type 7 on the printing type wheel 5. Thus, when the switching cam 65 makes one turn from the state indicated in FIG. 11 (*a*), both the first and second cam nails 63 and 64 engage with the peripheral surface outside the first and second cam grooves 66 and 67 and both the ink rolls 59 and 60 are separated again from the printing type wheels 7, 7'. The operations for the case where the switching cam 65 rotates in the reverse direction are identical to those described above. In either case, during the first half turn of the switching cam 65, either one of the ink rolls 59 and 60 is pushed against the printing type wheels 7, 7' and during the second half turn, the other of the ink rolls 59 and 60 is pushed against the printing type wheels 7, 7'.

Next, the transmission system controlling the rotation of the rotation shaft 1, the reset cam 29, the hammer 47, the switching cam 65, etc. will be explained, referring to FIGS. 13~15.

Figure 13:
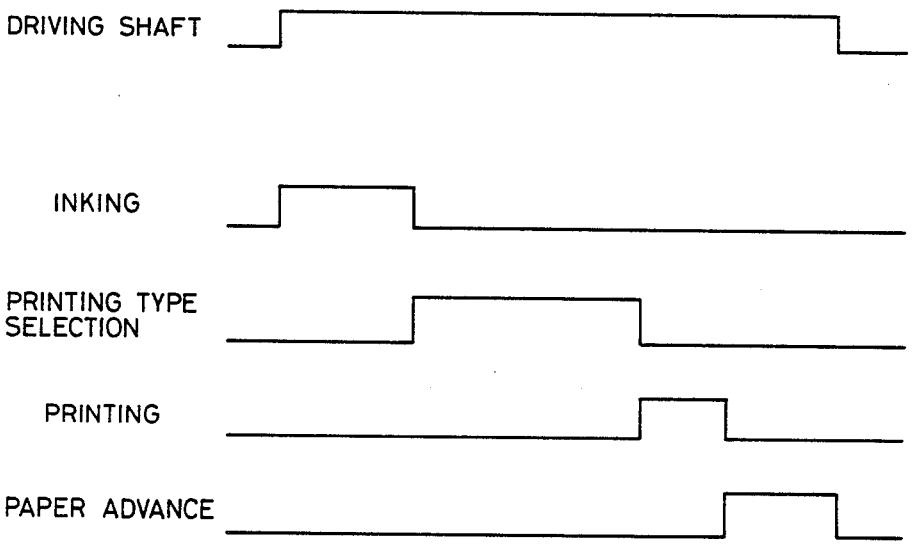
FIG. 13 is a timing chart showing the relation among the work of various parts during the printing operation for one line.

FIG. 13 is a timing chart showing the relation among the work of various parts during the printing operation for one line; FIG. 14 is a scheme for explaining schematically the working mode of the power transmission system; and FIGS. 15 (*a*) and (*b*) are schemes for explaining the clutch mechanism mounted on the power transmission system.

In FIG. 13 the rotation shaft 2 makes 1.5 turns in either one of the normal and reverse directions during the printing operation for one line. The inking operation is effected during the first about one half turn of this rotation shaft 2; the printing type selection operation is effected during the succeeding about one half turn; and the printing and the paper advancing operation are effected during the last about one half turn. Since among these operations the printing type selection operation is effected for the sake of positioning a desired printing type 7, 7' on the printing type wheel 5 at the printing position, the rotation shaft 2 must rotate slowly during this operation. To the contrary, during the inking operation for the sake of pushing the ink rolls 59 and 60 against the printing types 7 and 7' on the printing type wheels 5 and the paper advancing operation for the sake of advancing the recording paper, since the position control described above is unnecessary, the rotation shaft 2 must rotate fast during these operations.

Figure 14:
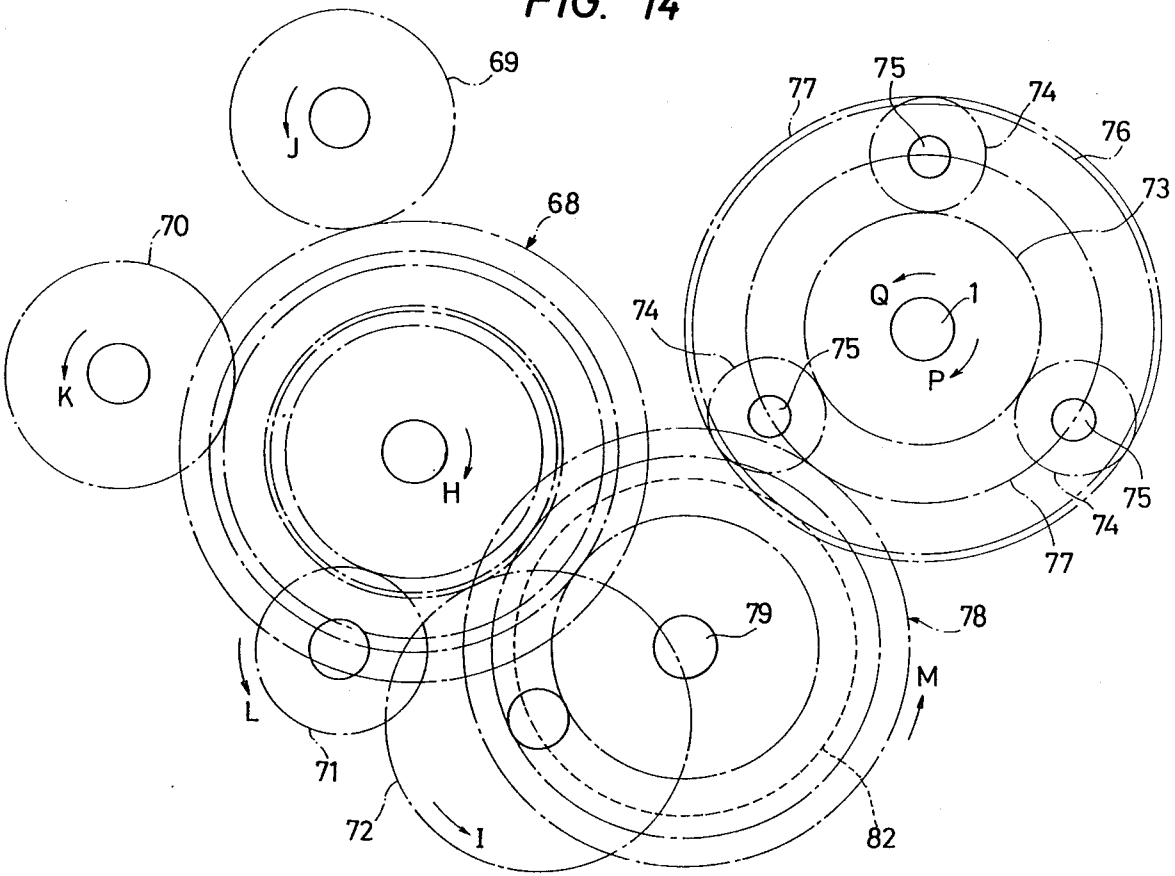
FIG. 14 is a scheme for explaining schematically the working mode of the power transmission system.

Such a control of the direction and the speed of the rotation is effected by the transmission system illustrated in FIG. 14. In this figure the reference numeral 68 indicates a driving gear including a plurality of gears in one body, which is rotated in a determined direction, e.g. in the direction indicated by the arrow H in the figure, with a constant speed by a motor rotating with a constant speed through an intermediate gear not shown in the figure. The reference numeral 69 is a hammer gear driving the hammer 47 stated previously; 70 a paper advancing gear driving the paper advancing roller 50; 71 a reset gear driving the reset cam; and 72 a rotation gear driving the rotation shaft 27. Among these gears the rotation gear 72 engages continuously with the driving gear 68 with a predetermined gear ratio and rotates with a constant speed in the direction indicated by the arrow I in the figure. The other hammer gear 69, paper advancing gear 70 and reset gear 71 engage with the driving gear 68 intermittently with their respective gear ratios and rotate in the direction indicated by the arrows J, K and L, respectively, only when the driving gear is at predetermined angular positions.

Further the reference numeral 73 represents a sun gear mounted in one body with the rotation shaft 1; 74 three planet gears engaging with this sun gear 73, circumscribed about it; 75 carrier shafts supporting these planet gears 74; 76 a carrier formed in one body with these carrier shafts 75; and 77 a ring gear engaging with these planet gears 74, circumscribed about them. These sun gear 73, planet gears 74, carrier 76 and ring gear 77 constitute a well-known planet gear train, in which the carrier 76 and the ring gear 77 are at the input side and the sun gear 73 is at the output side. The reference numeral 78 represents a selection gear disposed between the planet gear train thus constructed and the driving gear 68. This selection gear 78 is composed of three gears having different numbers of teeth in one body, among which two gears are engaged intermittently with the driving gear 68 and which rotate in the direction indicated by the arrow M in the figure with a predetermined timing or stop in this way. That is, this selection gear 78 rotates slowly when a gear having a large number of teeth engages with it, quickly when a gear having a small number of teeth engages with it, and stops when the part having no teeth of the selection gear 78 engages with the arc-shaped projection of the driving gear 68 (non of them are indicated in the figure).

Figure 15A:
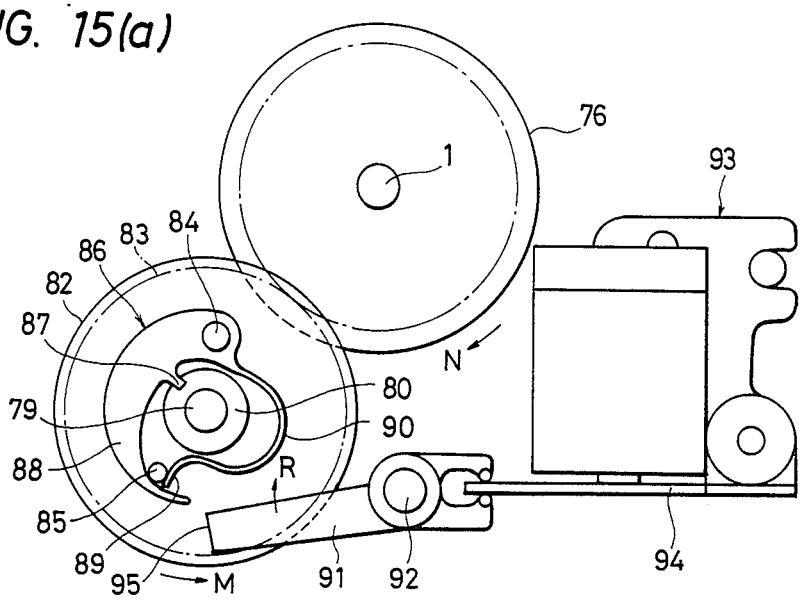
FIGS. 15 (*a*) and (*b*) are schemes for explaining the clutch mechanism mounted on the power transmission system.
Figure 15B:
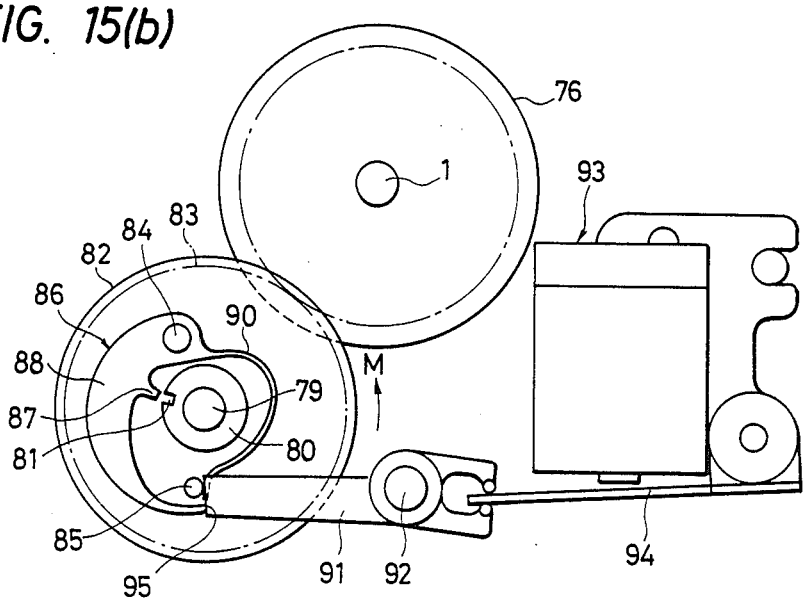
Figure 16:
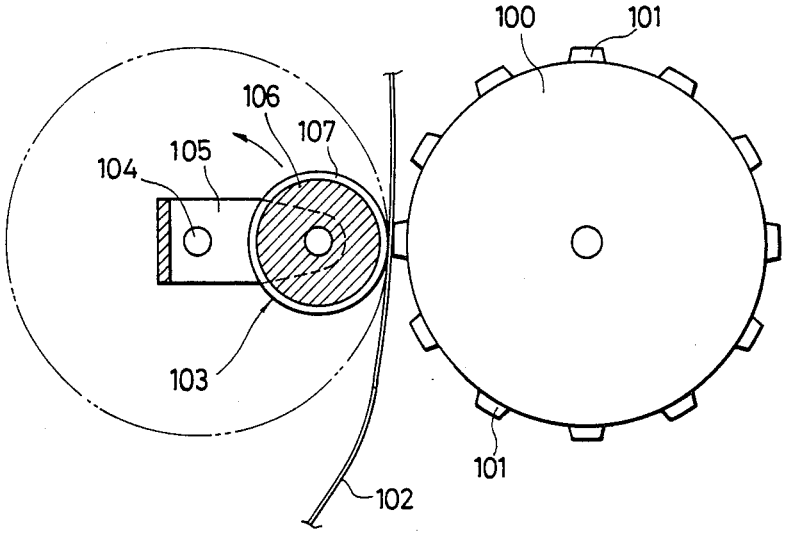
PRIOR ART FIG. 16
FIG. 16 is a scheme for explaining the hammer structure, with which a prior art printer is provided.

The rotational force of the selection gear 78 is transmitted to the ring gear 77 by the fact that the remaining gear of the selection gear 78 engages with the ring gear 77 and at the same time selectively to the carrier 76 stated above through a nail clutch mechanism indicated in FIG. 15.

In FIGS. 15 (*a*) and (*b*) the reference numeral 79 indicates a rotational supporting shaft of the selection gear 78 and a rotor 82 described later and 80 a driving shaft rotating with the selection gear 78 stated above in one body, on the peripheral surface of which a cut-off portion is formed. The rotor 82 is engaged with the rotational supporting shaft 79 and a toothed portion 83 engaging with the carrier 76 in the planet gear train stated above on its peripheral surface. In addition a supporting shaft 84 and an engaging shaft 85 are mounted with a predetermined distance thereon. The reference numeral 86 represents a driving nail transmitting the rotational force of the selection gear 78 to the rotor 82. This driving nail 82 consists of a first arm portion 88 having a projection 87, which has a certain rigidity and can engage with the cut-off portion 81 of the driving shaft 80, and a second arm portion 90, which is elastic and has a sliding portion 89 elastically in contact with the engaging shaft 85 of the rotor 82, the base portion of the first arm portion 88 being rotatably inserted in the supporting shaft 84 of the rotor 82. Further the reference numeral 91 represents a selection lever supported rotatably around a shaft 92 and 93 a solenoid having an actuator 94. The selection lever 91 is switched by means of this solenoid 93 between two positions, the engaging position where it is opposite to the driving nail 86 and the non-engaging position where it is separated from the rotational trajectory of the driving nail 86.

In such a nail clutch mechanism thus constructed, in the state where the projection 87 of the driving nail 86 is engaged with the cut-off portion 81 of the driving shaft 80, as indicated in FIG. 15 (*a*), and at the same time in the state where electric current flows through the solenoid 93 and its actuator 94 holds the selection lever 91 at the non-engaging position with the driving nail 86, when the rotational supporting shaft 79 and the driving shaft 80 rotate in the direction indicated by the arrow M in the figure with the rotation of the gear 78, the driving shaft 80 and the rotor 82 rotate in one body in the direction indicated by the arrow M in the figure owing to the engagement of the projection 87 of the driving nail 86 with the cut-off portion 81. The rotational force of this rotor 82 is transmitted to the carrier 76 engaging with the toothed portion 83 and thus the carrier 76 rotates in the direction indicated by the arrow N in the figure. At this time, the rotational force of the selection gear 78 rotating in synchronism with the driving shaft 80 is transmitted to the ring gear 77, the planet gears 74 and the sun gear 73, as described previously. Consequently, in this case, the rotational force of the motor is transmitted to the carrier 76 and the ring gear 77, which are two input shafts of the planet gear train described above, through the selection gear 78 and the rotor 82 rotating in one body therewith, and the sun gear 73, which is the output side of the planet gear train, rotates e.g. in the direction indicated by the arrow P in FIG. 14, what can rotate the rotation shaft 1, which is formed in one body with the sun gear 73, equally in the direction indicated by the arrow P.

To the contrary, in the case where it is desired that the rotation shaft 1 rotates in the direction indicated by the arrow Q in FIG. 14, the electric current flowing through the solenoid 93 is interrupted. As the result the selection lever 91 rotates in the direction indicated by the arrow R in FIG. 15 (*a*) owing to the spring force of a spring not shown in the figure and the selection lever 91 is held at the engaging position, where it can be opposite to the driving nail 86, as indicated in FIG. 15 (*b*). In this state, when the rotor 82 rotates in the direction indicated by M in the figure together with the driving shaft 80 in one body, the extremity of the first arm portion 88 of the driving nail 86 is brought into contact with the guide portion 95 disposed at the extremity of the selection lever 91 and the first arm portion 88 moves outward with the succeeding rotation of the driving shaft 80, guided by a guide portion 95. That is, the driving nail 86 is expanded against the spring force of the second arm portion 90. By this fact the engagement of the projection 87 of the first arm portion 88 with the cut-off portion 81 is removed and the transmission of the rotational force of the driving shaft 80 to the rotor 82 is interrupted. Consequently, in this case, although the rotational force of the motor is transmitted to the ring gear 77, which is one of the two input shafts of the planet gear train through the selection gear 78, it is not transmitted to the carrier 76, which is the other of the two input shafts. Therefore, the sun gear 73 and the rotation shaft 1 formed in one body therewith rotates in the direction indicated by the arrow Q in FIG. 14. Furthermore the ratio of the speed in the direction indicated by the arrow P of the rotation shaft 1 constructed as explained above to that in the direction indicated by the arrow Q is determined by the gear ratio between the planet gear 74 and the ring gear 77, etc. In this embodiment these gear ratios are so set that the driving shaft rotates with a same speed in the normal and the reverse direction.

In the embodiment constructed as described above, basically operations, which will be described later, are effected by driving the motor.

<INKING>

As indicated in FIG. 1, in the state where the protrusion 21 of the driving nail 20 is engaged with a cut-off portion 3 or 4 of the driving shaft 2, when the printing type wheel 5 rotates in the predetermined direction with the rotation of the driving shaft 2, the switching cam 65 indicated in FIG. 10 rotates to a predetermined position together with the outermost printing type wheel in one body. In this way the first ink roll 59 is pushed against the first printing type 7 on the printing type wheel 5 and the second ink roll 60 is pushed against the second printing type 7' during one turn of the switching cam 65. That is, e.g. for a red printing red ink on the first ink roll 59 is applied on the first printing type 7 on the printing type wheel 5 during the first about one half turn of the driving shaft 2 in the direction indicated by the arrow F in FIG. 11 (*a*). The printing type wheel 5, for which red ink is applied in this way on the first printing type 7, is subjected to the printing type selection operation described later during the succeeding about one half turn of the driving shaft 2 and the desired printing type 7 is positioned at the printing position. On the other hand, when the driving shaft 2 rotates in the direction opposite to that stated above, black ink on the second ink roll 60 is applied on the second printing type 7' on the printing type wheel 5 during the first about one half turn of the driving shaft 2 and during the succeeding about one half turn of the driving shaft 2 the desired printing type 7', on which black ink is applied, is selected at the printing position.

<PRINTING TYPE SELECTION>

In this way, when desired ink is applied on the printing type 7 or 7' during the first about one half turn of the driving shaft 2, each of the printing type wheels 5 is stopped at a desired position during the succeeding about one half turn of the driving shaft and the desired printing type 7, 7' is selected at the position opposite to the hammer 47. Since such a printing type selection operation has been already explained, detailed explanation therefor is omitted here. Further, according to circumstances, there may be printing type wheels, for which no printing type selection operation is needed, and in this case, since the engaging protrusion 14 of the selection ratchet 6 is necessarily engaged at a predetermined position with the nail portion 26 of the selection nail 25 during one turn of each of the printing type wheels 5, for which no printing type is selected, the transmission of the rotational force from the driving shaft 2 to the selection ratchet 6 and the printing type wheel 5 is interrupted at this position and thus the printing type wheel 5 is stopped. At this time, since the stop operation of the selection ratchet 6 by means of the selection nail 25 is effected automatically by the engaging protrusion 14 of the selection ratchet 6 and the nail portion 26 at the extremity of the selection nail 25, it is not necessary to supply electric current to the electromagnetic clutch 31, which is necessary for the printing type selection operation, and therefore it is possible to reduce electric power consumption. In this case the position where the printing type wheel 5, for which no printing type is selected, is stopped is e.g. the position indicated in FIG. 1 and at this position the printing type 7, 7' disposed on that printing type wheel 5 is located at a position where it is not opposite to the hammer 47.

As it is clear from the above explanation, when the driving shaft 2 rotates by about 180° e.g. clockwise in the figure from the initial state indicated in FIG. 1, black ink on the second ink roll is applied on the printing type 7' during the rotation. The desired printing type wheel 5 is stopped during the succeeding about one half turn of the driving shaft 2, i.e. during the rotation from 180° to 360° counted from the initial state and at the same time the printing type wheels, for which no printing type has been selected before the end of the rotation, are stopped. When the inking and the printing type selection have been effected in this way during about one turn of the driving shaft 2, the driving shaft 2 stops and a printing operation is effected thereafter. Further, when the driving shaft 2 makes about one turn e.g. counterclockwise in the figure from the initial state indicated in FIG. 1, red ink is applied on the printing type 7 on the printing type wheel 5 and at the same time the printing type selection is effected in the same way for the printing type wheel 5, on which red ink is applied.

<PRINTING>

The printing type 7 or 7′ on the printing type wheels 5 for all the digits, for each of which a printing type is selected, is opposite to the projecting portion of the hole 57 in the erroneous printing preventing plate 48 and protrudes through the projecting portion 58 towards the hammer 47. (For the printing type wheels 5, for which no printing type is selected, a blank part where there is no printing type 7, 7′ is opposite to the projecting portion 58.) On the other hand recording paper is carried along the paper guide 49 on the erroneous printing preventing plate 48 by the rotation of the paper advancing roller 50 and the driven roller 51. In this state, when the hammer 47 rotates counterclockwise in FIG. 1, the recording paper is pushed against the selected printing type 7, 7′ by the thrusting portion 52 of the hammer 47 and printing for one line is effected. Furthermore, as described previously, since the surface of the thrusting portion 52 of the hammer 47 is hard in spite of its flexibility and the printing type wheels 5 are separated for every digit, clear printing types are transcribed on the recording paper.

During the printing operation described above the printing type wheels 5, which stand still at the printing position, are subjected to the rotational force in a predetermined direction, when they are in contact with the rotating hammer 47. In this embodiment measures are adopted for preventing that the printing position of the printing type wheels 5 is not shifted by the rotational force stated above. Hereinbelow these measures will be explained, referring to FIGS. 5 (*b*) and (*c*).

FIG. 5 (*b*) indicates, as mentioned previously, the state where the engagement of the protrusion 21 of the driving nail 20 with the cut-off portion 3 of the driving shaft 2 rotating in the direction indicated by the arrow A is removed and the printing type wheels 5 stand still at the printing position, i.e. the state where the printing type is selected. In this case, since the nail portion 26 of the selection nail 25 engages with the toothed portion 13 of the selection ratchet 6 and the engaging shaft 11 and the supporting shaft 12 of the printing type wheel 5 engage with the extremity portions of the engaging holes formed in the selection ratchet 6, even if the hammer 47 exerts the rotational force in the direction indicated by the arrow A on the printing type wheel 5 in such a state, the printing type wheel 5 doesn't rotate. That is, in the case where the rotational direction of the driving shaft 2 differs from that of the hammer 47, in other words in case where the direction of the rotational force exerted by the hammer 47 on the printing type wheel 5 is the same as that of the driving shaft 2, the rotation of the printing type wheel 5 is regulated by the fact that its engaging shaft 11 and supporting shaft 12 are stopped by the engaging holes 18 and 19 of the selection ratchet 6, respectively, which is engaged by the selection nail 25, and therefore the printing type wheel 5 is held at the printing position.

In the case where the rotational direction of the driving shaft 2 is opposite to that stated above, i.e. in the state where the engagement of the protrusion 21 of the driving nail 20 with the cut-off portion 3 of the driving shaft 2 rotating in the direction indicated by the arrow D is removed, as indicated in FIG. 5 (c), the nail portion 26 of the selection nail 25 is engaged with the lock groove 8 formed on the printing type wheel 5 through a gap between teeth in the toothed portion 13 of the selection ratchet 6. Owing to the fact that also the printing type wheel 5 is stopped by the selection nail 25 in this way, in this state the printing type wheel 5 doesn't rotate, even if the rotational force in the direction indicated by the arrow A, which is opposite to that indicated by the arrow D, is exerted by the hammer 47 on the printing type wheel 5. If in the state indicated in FIG. 5 (*c*) the lock groove 8 formed in the printing type wheel 5 were not stopped by the selection nail, although the rotation of the printing type wheel 5 is limited by the engagement of the engaging shaft 11 and the supporting shaft 12 of the printing type wheel 5 with the engaging holes 18 and 19 formed in the selection ratchet 6 when the rotational force in the direction indicated by the arrow D is exerted on the printing type wheel 5, the limitation of the rotation of the engaging shaft 11 and the supporting shaft 12 by the engaging holes 18 and 19 would not be exerted and the printing type wheel 5 would rotate a little, i.e. by an amount corresponding to the clearance between the engaging shaft 11 as well as the supporting shaft 12 and the engaging holes 18, 19, wwhen the rotational force in the direction indicated by the arrow A is exerted on the printing type wheel 5. consequently, in the case where the rotational direction of the driving shaft 2 is the same as that of the hammer 47, in other words in the case where the direction of the rotational force exerted by the hammer 47 on the printing type wheel 5 differs from the rotational direction of the driving shaft 2, the rotation of the printing type wheel 5 is limited by the fact that the selection nail 25 is engaged with the lock groove 8 formed thereon and held at the printing position.

<RESET>

When the printing operation is terminated in this way, the driving shaft 2, which has stood still up to this moment, begins to make again about one half turn, i.e. to rotate from 360° to 540° counted from the initial state and further the toothed portion 13 of the selection ratchet 6 and all the selection nails 25, which have been engaged with the engaging protrusion 14 are rotated by the reset cam 29 to the waiting state. That is, when the reset cam 29 rotates counterclockwise in FIG. 1, as indicated e.g. in FIG. 6 (*b*), the selection nail 25 engaging with the toothed portion 13 of the selection ratchet 6 rotates in the direction indicated by the arrow C by the fact that the cam nail 30 rises from the step-down portion 45 of the reset cam 29 on the projecting portion 46 and in this way the engagement of the nail portion 26 of the selection nail 25 with the toothed portion 13 of the selection ratchet 6 is removed. Such an operation is effected simultaneously for the selection nail 25 mounted on each of all the printing type wheels 5 and the engaging state is removed not only for the selection nails, which have engaged with the toothed portion 13 of the selection ratchet 6, but also for the selection nails, which have engaged with the engaging protrusion 14, and therefore all the selection nails 25 are held in the waiting state by means of the reset cam 29 and the thrusting spring 33. In addition, the angular position of the printing type wheels 5 for various digits standing still at the printing position is different, depending on the printing type selection. For example, the printing type wheel 5, for which no printing type is selected, is stopped at a position, up to which it has made almost one turn counted from the initial state. To the contrary, the printing type wheel 5, for which a printing type is selected, is stopped at an angular position, whose angle is smaller than that for the former case.

When the state where the selection ratchet 6 is engaged with the selection nail 25 is removed in this way, the printing type wheel 5 and the selection ratchet 6, which have been engaged at the printing position up to this moment, rotate together with the driving shaft 2 in one body owing to the fact that the driving nail 21 is brought elastically into contact with the peripheral surface other than the cut-off portions 3 and 4 of the driving shaft 2. Then, when an engaging projection 96 mounted on the peripheral portion of the printing type wheel 5 is brought into contact with the nail portion 26 of the selection nail 25, which is in the waiting position described above, since the rotational force of the driving shaft 2 transmitted to the printing type wheel 5 is only the spring force of the driving nail 20, which is very small, the printing type wheel 5 and the selection ratchet 6 stop at the waiting position and the protrusion 21 of the driving nail 20 slips on the peripheral surface of the driving shaft 2 during the succeeding rotation of the driving shaft 2. Since the engaging projection 96 stated above is disposed at a desired position on each of the printing type wheels 5, concretely speaking, at a position exterior to the engaging protrusion 14 on the selection ratchet 6, the printing type wheels 5, whose rotation angles are otherwise different, stop with a constant angular position by the fact that the engaging projection 96 is stopped by the selection nail 25, i.e. all the digits are aligned at the state where the printing type wheels 5 have made about one turn from the initial state.

In this way, when the engaging projections 96 of the printing type wheels 5 for all the digits are stopped by the selection nails 25, the protrusion 21 of the driving nail 2 is engaged again with one of the cutoff portions 3 and 4 of the driving shaft 2. In this case, as mentioned previously, since the rotation angle counted from the initial state of the printing type wheel 5, the selection ratchet 6 and the driving nail 20 is about one turn, while that of the driving shaft is 1.5 turns, e.g. the protrusion 21 of the driving shaft 20, which was engaged with one of the cut-off portion 3 of the driving shaft 2 in the initial state, engages with the other cut-off portion 4 of the driving shaft 2 in the reset position. Then, when the driving shaft 2 rotates succeedingly by a certain angle, i.e. when it makes nearly 1.5 turns counted from the initial state, the printing type wheel 5 and the selection ratchets 6 rotate together with the driving shaft 2 in one body. Since the rotational force of the driving shaft 2 transmitted to the printing type wheel 5 is very large due to the engagement of the protrusion 21 of the driving nail 20 with the cut-off portion 3, 4 of the driving shaft 2, the selection nail 25 is rotated outward against the spring force of the thrusting spring 33 by the engaging projection 96 of the printing type wheel 5 rotating with the driving shaft 2 in one body, i.e. the nail portion 26 of the selection nail 25 overrides the engaging projection 96 and thus the initial state indicated in FIG. 1 is realized, where the printing type wheel 5 and the selection ratchet 6 also stop with the stop of the rotation of the driving shaft 2.

<PAPER ADVANCE>

When the printing operation described above is terminated, parallelly to the reset operation mentioned above, the paper advancing roller 50 is rotated counterclockwise in FIG. 1 and the recording paper put between the paper advancing roller 50 and the driven roller 51 is carried by a predetermined amount by the rotation of the paper advancing roller 50.

The printing for one line is effected through the steps explained above, i.e. <INKING>, <PRINTING TYPE SELECTION>, <PRINTING>, <RESET> and <PRINTING TYPE SELECTION> and a desired printing can be effected by repeating this process. By selecting the direction of the rotation of the driving shaft, i.e. as mentioned previously, by selecting either one of the rotational directions, normal and reverse, of the driving shaft 2 by means of the nail clutch mechanism indicated in FIG. 15, it is possible to select one of the two operation modes, red printing and black printing.

As explained above, according to this invention, it is possible to provide a printer, in which not only the thrusting force acts uniformly on the printing type wheels, but also the hammer, whose surface is hard and which is deformable, can be formed in one body, and which is therefore not expensive and permits to obtain clear print of separated digits.

The embodiments of the invention in which an exclusive property or privilege is claimed are defined as follows:

1. A printer comprising a plurality of type wheels arranged in parallel on a common rotational axis, each provided with a set of type elements on the periphery thereof, means for selectively stopping said type wheels to hold selected ones of the type elements on said type wheels at a printing position aligned in one row parallel to the axis of said type wheels, a hammer facing opposite the row of type elements of said type wheels at said printing position, means for feeding a recording paper between said type wheels and said hammer at said printing position, and means for actuating said hammer so that said hammer presses the recording paper against the type elements in the one row for printing on the recording paper, wherein said hammer is formed as a single body rotatable on a shaft having an axis parallel to the axis of said type wheels, and said single body is integrally form with a plurality of chevron shaped thrusting portions arranged in a row spaced apart in a comb-like configuration parallel to the shaft axis and extending therefrom and corresponding to the spacing of the type elements, and said means for actuating said hammer including means for rotating said shaft to bring said row of thrusting portions to said printing position to press the recording paper against said row of type elements.

2. A printer according to claim 1, wherein said hammer is made of a relatively hard synthetic resin, and said thrusting portions are formed hollow in cross-section.

* * * * *